US008291532B2

(12) United States Patent
Hornbach et al.

(10) Patent No.: US 8,291,532 B2
(45) Date of Patent: Oct. 23, 2012

(54) CANISTER LIFT FOR A PATIENT SUPPORT APPARATUS

(75) Inventors: David Hornbach, Brookville, IN (US); Darrell Metz, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 11/762,389

(22) Filed: Jun. 13, 2007

(65) Prior Publication Data

US 2007/0294828 A1 Dec. 27, 2007

Related U.S. Application Data

(60) Provisional application No. 60/815,477, filed on Jun. 21, 2006.

(51) Int. Cl.
*A61G 7/00* (2006.01)

(52) U.S. Cl. ..... 5/611; 5/11

(58) Field of Classification Search ..... 5/11, 611, 5/614; 254/102; 108/147, 147.19, 7
See application file for complete search history.

(56) References Cited

U.S. PATENT DOCUMENTS

| | | | | |
|---|---|---|---|---|
| 5,172,442 | A | 12/1992 | Bartley et al. | |
| 5,343,581 | A | 9/1994 | Bartley et al. | |
| 5,636,394 | A * | 6/1997 | Bartley | 5/611 |
| 5,903,940 | A | 5/1999 | Voelker et al. | |
| 6,375,355 | B1 * | 4/2002 | Fortin | 378/209 |
| 6,678,907 | B1 * | 1/2004 | Voelker et al. | 5/611 |
| 6,880,416 | B2 | 4/2005 | Koch | |
| 6,928,679 | B1 * | 8/2005 | Gross | 5/638 |
| 2005/0252429 | A1 | 11/2005 | Logan et al. | |
| 2006/0031991 | A1 | 2/2006 | McDaniel et al. | |

FOREIGN PATENT DOCUMENTS

| | | | |
|---|---|---|---|
| DE | 20207648 | U1 | 10/2002 |
| DE | 102005040976 | A1 | 2/2007 |
| EP | 685216 | B1 | 7/1999 |
| EP | 1018312 | B1 | 6/2002 |
| WO | 2005048904 | A1 | 6/2005 |

* cited by examiner

*Primary Examiner* — William Kelleher
(74) *Attorney, Agent, or Firm* — Jason Penninger

(57) ABSTRACT

A lifting device for a patient support apparatus is provided. The patient support apparatus includes a frame and a lifting device coupled to the frame. The lifting device is configured to move the frame between a raised position and a lowered position. The lifting device includes a motor and at least two canisters. The motor is operably coupled to at least one of the canisters to rotate the canister.

30 Claims, 10 Drawing Sheets

CANISTER LIFT FOR A PATIENT SUPPORT APPARATUS

CROSS REFERENCE TO RELATED APPLICATIONS

This application claims the benefit of and priority to U.S. Provisional Application Ser. No. 60/815,477, filed Jun. 21, 2006, which is hereby incorporated by reference.

BACKGROUND

1. Field

The present invention relates to patient support apparatuses, such as beds, stretchers, and infant incubators that may be appropriate for use in hospitals, acute care facilities, and other patient care environments including home care. Further, the present invention relates to devices capable of lifting or moving at least a portion of a patient support apparatus.

2. Description of Related Art

Known patient support apparatuses are disclosed in, for example, U.S. Pat. No. 5,630,238 to Weismiller et al., U.S. Pat. No. 5,715,548 to Weismiller et al., U.S. Pat. No. 6,047,424 to Osborne, et al., U.S. Pat. No. 6,076,208 to Heimbrock et al., U.S. Pat. No. 6,240,584 to Perez et al., U.S. Pat. No. 6,320,510 to Menkedick et al., U.S. Pat. No. 6,378,152 to Washburn et al., U.S. Pat. No. 6,499,167 to Ellis et al., U.S. Pat. No. 6,584,628 to Kummer et al., all of which are owned by the assignee of the present invention and all of which are hereby incorporated by reference.

SUMMARY

According to one embodiment of the present invention, a patient support apparatus is provided. The patient support apparatus includes a base frame, an intermediate frame, and a lift device coupled to the intermediate frame. The lift device is configured to move the intermediate frame between raised and lowered positions relative to the base frame. The lift device includes a motor, an upper canister, and a lower canister. The motor is operably coupled to the upper canister to move the upper canister relative to the lower canister.

According to another embodiment of the present invention, a lift device for vertical movement of a patient support apparatus is provided. The lift device comprises an upper assembly, a motor, an upper canister, at least one intermediate canister, and a lower canister. The motor is coupled to the upper assembly. The upper canister includes a threaded portion and is operably coupled to the motor. The at least one intermediate canister includes a first inner threaded portion and a second outer threaded portion. The lower canister includes an inner threaded portion. The first inner threaded portion is provided for cooperation with the threaded portion of the upper canister to facilitate vertical movement of the tipper canister relative to the intermediate canister. The inner threaded portion is provided for cooperation with the first outer threaded portion to facilitate vertical movement of the intermediate canister relative to the lower canister.

Additional features and advantages of the invention will become apparent to those skilled in the art upon consideration of the following detailed description of illustrated embodiments.

BRIEF DESCRIPTION OF THE SEVERAL VIEWS OF THE DRAWINGS

The detailed description particularly refers to the accompanying figures in which.

DETAILED DESCRIPTION

Figure 1:
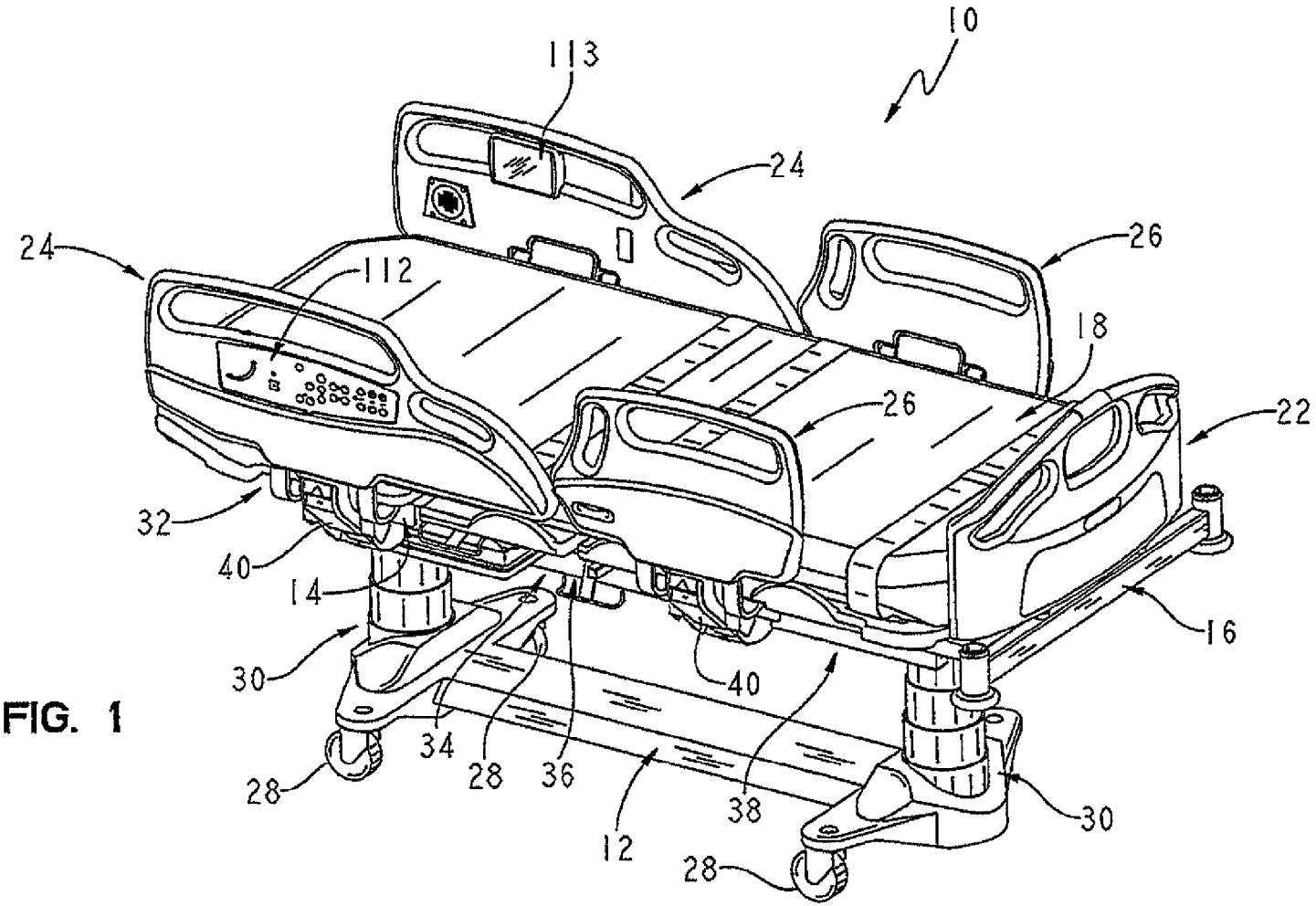
FIG. 1 is a perspective view of a patient support apparatus according to the present disclosure showing the patient support apparatus including a frame, a deck, a mattress supported by the deck, a foot board, a pair of head end siderails, and a pair of foot end siderails.

For the purpose of promoting an understanding of the principles of the invention, reference will now be made to the embodiments illustrated in the drawings and specific language will be used to describe the same. It will nevertheless be understood that no limitation of the scope of the invention is hereby intended. Any alterations or further modifications of the described embodiments and/or further applications of the principles of the invention as illustrated herein as would normally occur to one skilled in the art to which the invention relates are contemplated as within the scope of the invention.

A patient support apparatus 10 is shown in FIG. 1. In the illustrated embodiment, patient support apparatus 10 includes a base frame 12, an intermediate frame 14 supported by base frame 12, a deck 16 supported by intermediate frame 14, a mattress 18 supported by deck 16, a headboard (not shown), a footboard 22, a pair of head end siderails 24, and a pair of foot end siderails 26.

Base frame 12 is supported on the floor by a plurality of caster wheels 28 and may include a centered or fifth wheel assembly (not shown). Additional details of suitable casters and a suitable fifth wheel assembly is provided in U.S. patent application Ser. No. 10/557,524, titled "Hospital Bed," filed Nov. 18, 2005 to Hensley et al., which is expressly incorporated by reference herein.

Figure 8:
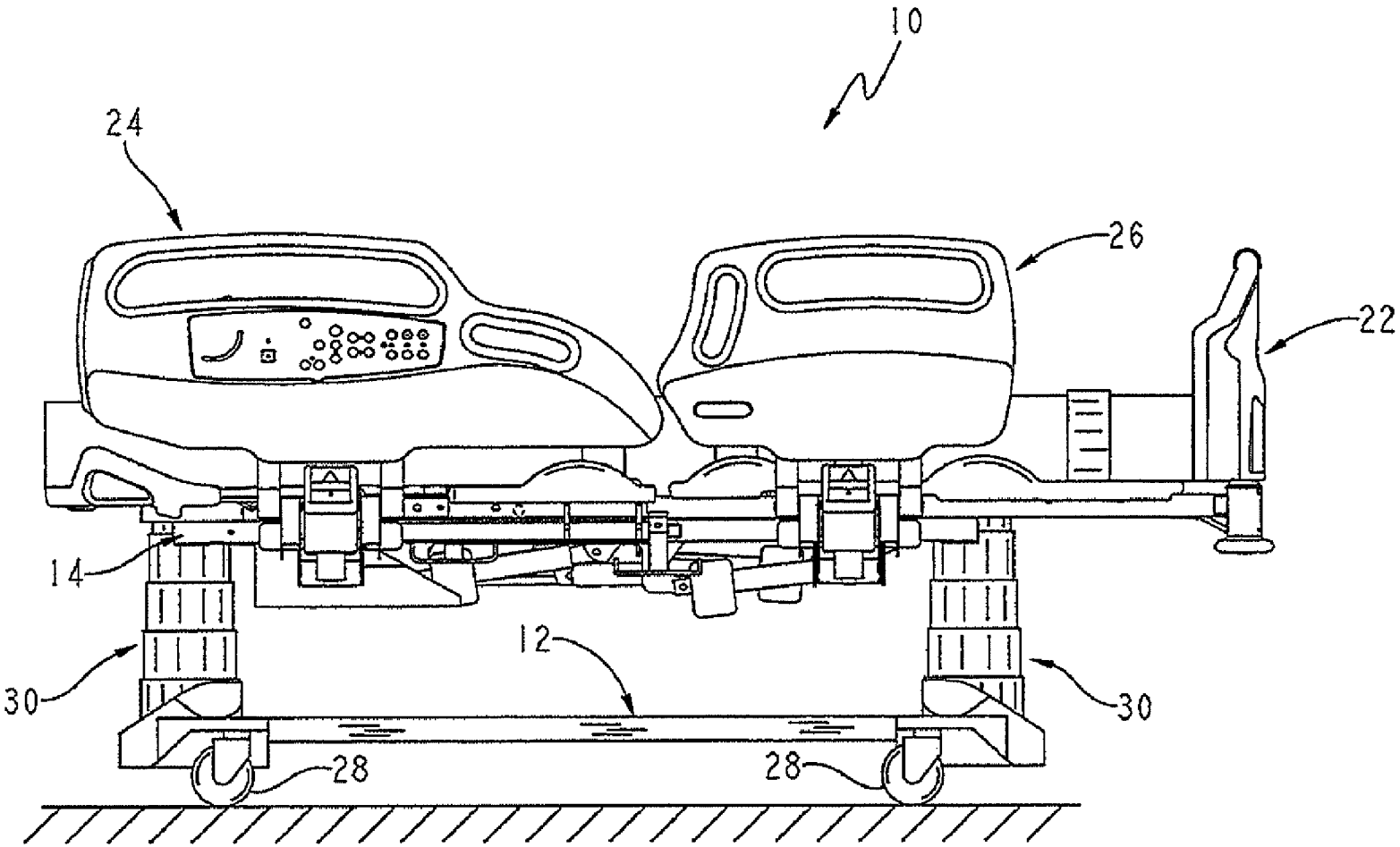
FIG. 8 is a side view of the patient support apparatus in the raised position.
Figure 9:
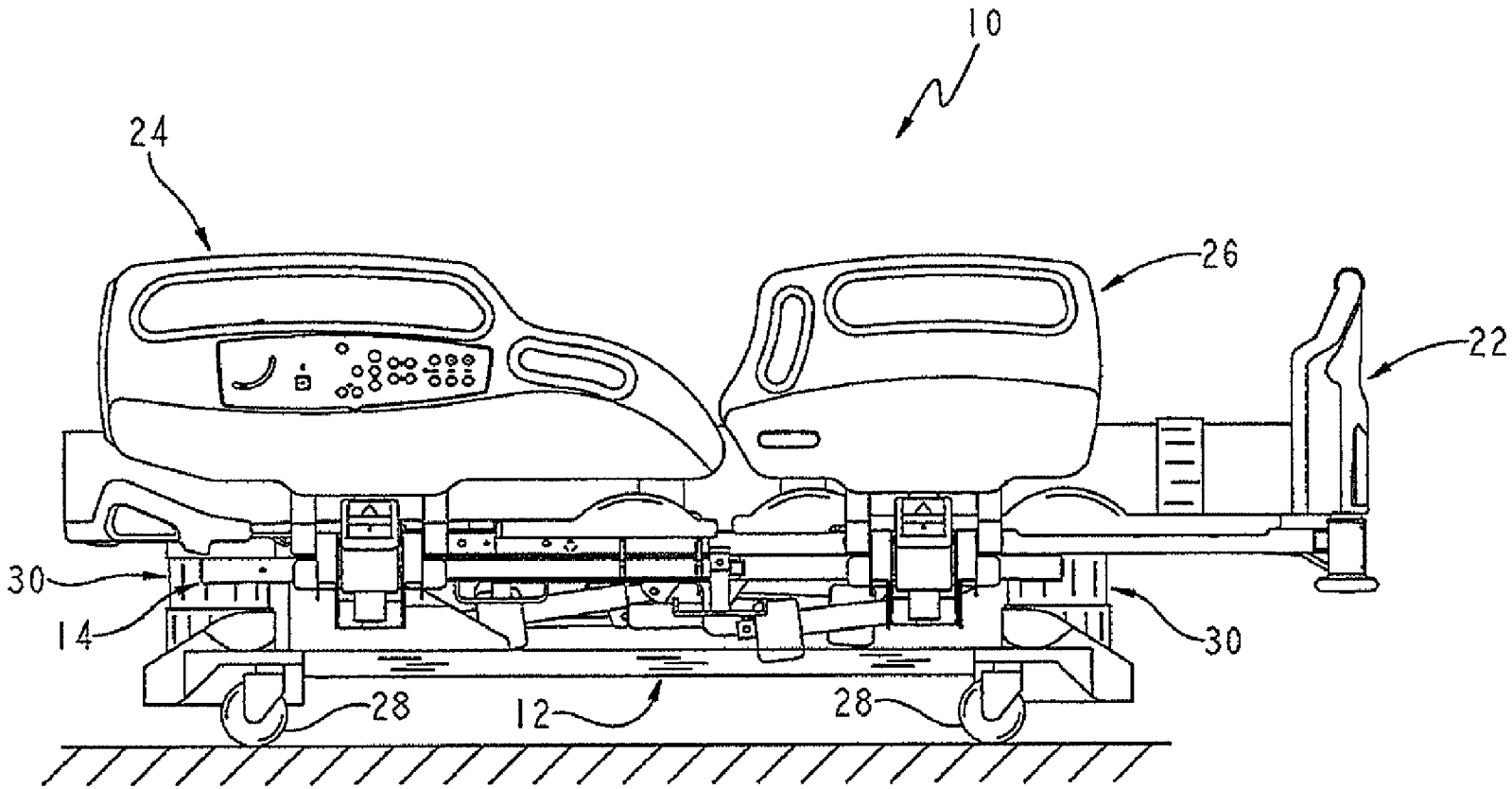
FIG. 9 is a side view of the patient support apparatus in the lowered position.
Figure 10:
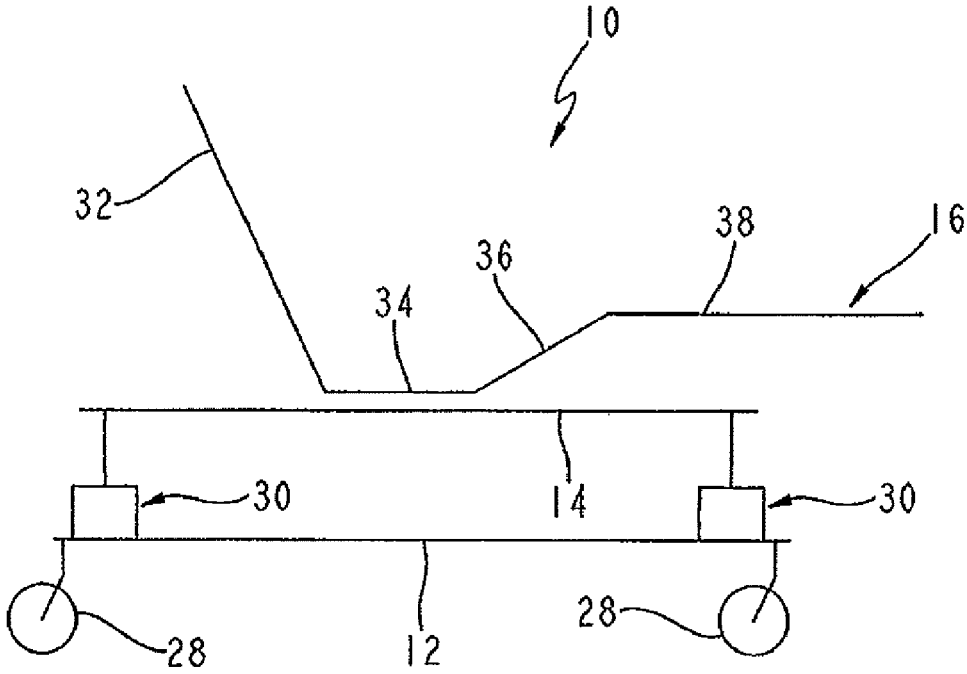
FIG. 10 is a diagrammatic view showing the patient support apparatus in a position with the head section in the raised position and a foot section in an elevated position.
Figure 11:
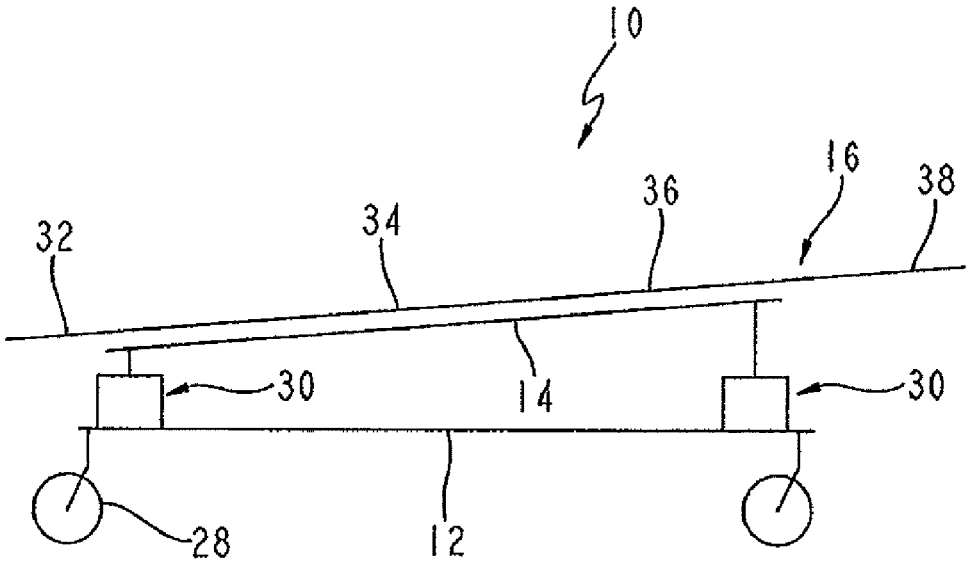
FIG. 11 is a diagrammatic view showing the patient support apparatus in a Trendelenburg position.

Intermediate frame 14 is coupled to one or more lifting devices 30. One or more lifting devices 30 can be extended or retracted to position intermediate frame 14 and deck 16 in, for example, the Trendelenburg or Reverse Trendelenburg positions, or to move patient support apparatus 10 between a lowered position (FIG. 9) and a raised position (FIG. 8). As shown in FIG. 1, a pair of lifting devices 30 may be provided, with each lifting device being located substantially near each end of the frame 12, respectively. In other embodiments, one or more lifting devices 30 may be used and such devices lifting 30 may be positioned at other locations substantially underneath intermediate frame 14. For example, four lifting devices 30 may be used such that each lifting device 30 is positioned at a respective corner of the patient support apparatus 10, such that a pair of lifting devices would be located at the head end of the patient support apparatus, and a pair of lifting devices would be located at the foot end of the patient support apparatus. Other configurations are possible, such as those that use less than or more than one pair or two pairs of lifting devices.

While base frame 12 and intermediate frame 14 are shown in the accompanying figures, it should be understood that additional frames could be a part of the patient support apparatus 10. For example, a weigh frame is another type of frame that is typically a part of patient support apparatuses in the art. Further, those of ordinary skill in the art may refer to the intermediate frame as the weigh frame or vice versa. Thus, it should be understood that the usage of intermediate frame and weigh frame does not limit the frame to that particular type but is used to identify the specific frame in question. In addition, those of ordinary skill in the art may use other terminology when referring to the base frame, the weigh frame, and/or the intermediate frame. All equivalents and ordinary names given to frames of this type are contemplated as being within the scope of this specification. Thus no limitation is meant or should be interpreted by one usage over the other.

Deck 16 is configured to articulate between a plurality of positions. In the illustrated embodiment, deck 16 includes a head section 32, a seat section 34, a thigh section 36, and a foot section 38, all of which are pivotably coupled together. In general, deck section 16 has at least one or more articulating sections, the articulating section or sections being any of the head, seat, thigh, or foot sections, although the deck having at least one articulating section is not required. Further, each section of deck section 16 can be articulating.

One or more siderails are generally provided with patient support apparatuses that are capable of being raised and lowered or articulated. In the illustrated embodiment, head end siderails 24 are coupled to head section 32 and may be moved between raised and lowered positions by respective siderail linkages 40. Foot end siderails 26 are respectively coupled to intermediate frame 14 by siderail linkages 40 between thigh section 36 and foot section 38 and can also be moved between raised and lowered positions. Additional details of suitable siderails and siderail linkages are provided in U.S. patent application Ser. No. 10/557,524, titled "Hospital Bed," filed Nov. 18, 2005 to Hensley et al., PCT Publication No. WO 02/32271 A1, titled "Bed with Articulated Barrier Elements," filed Oct. 18, 2000, to Hensley et al., and U.S. Pat. No. 6,163,903, titled "Chair Bed," filed Feb. 4, 1998, to Weismiller et al, all of which are expressly incorporated by reference herein.

Figure 2:
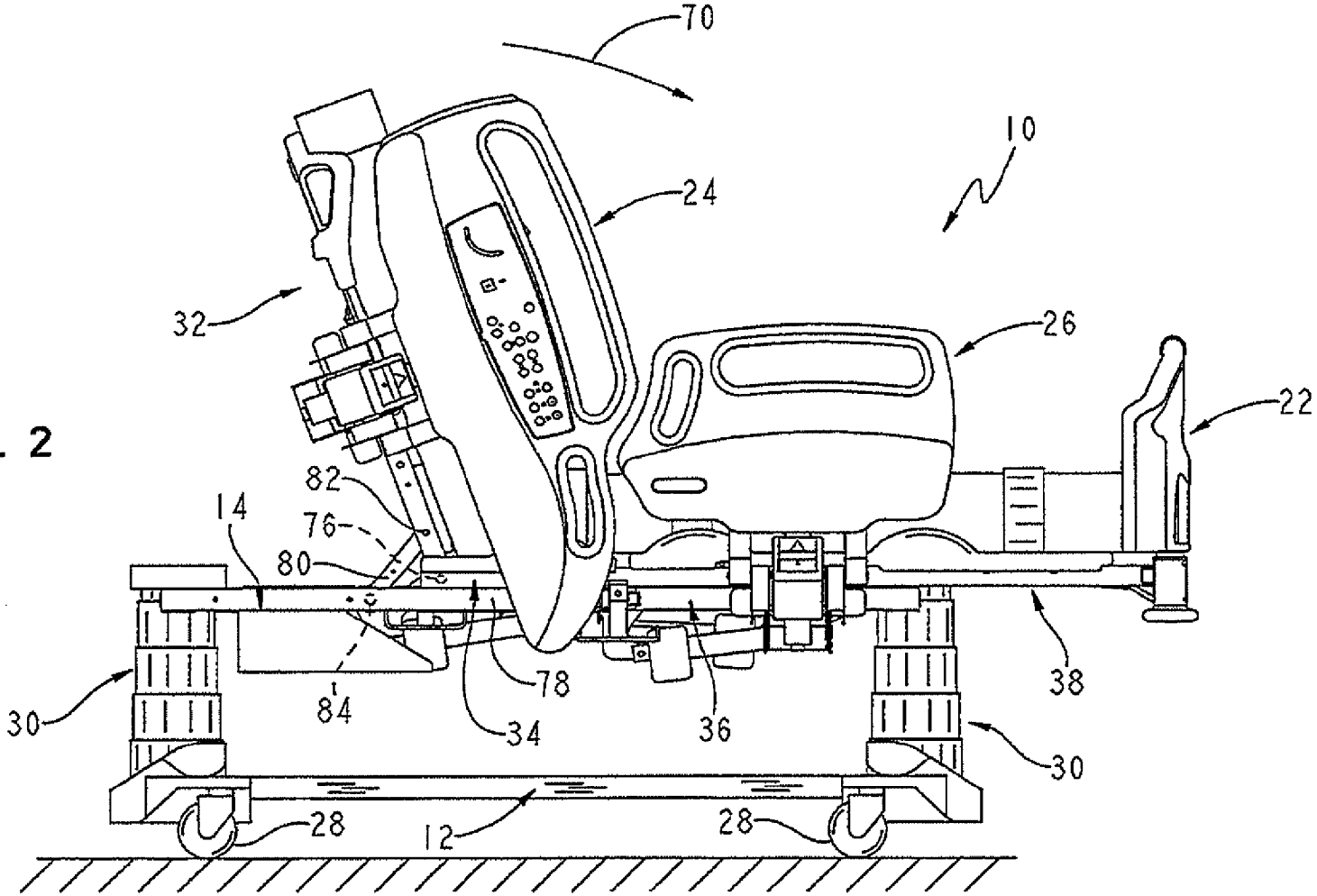
FIG. 2 is a perspective view similar to FIG. 1 showing a head section of the deck in a raised position.
Figure 3:
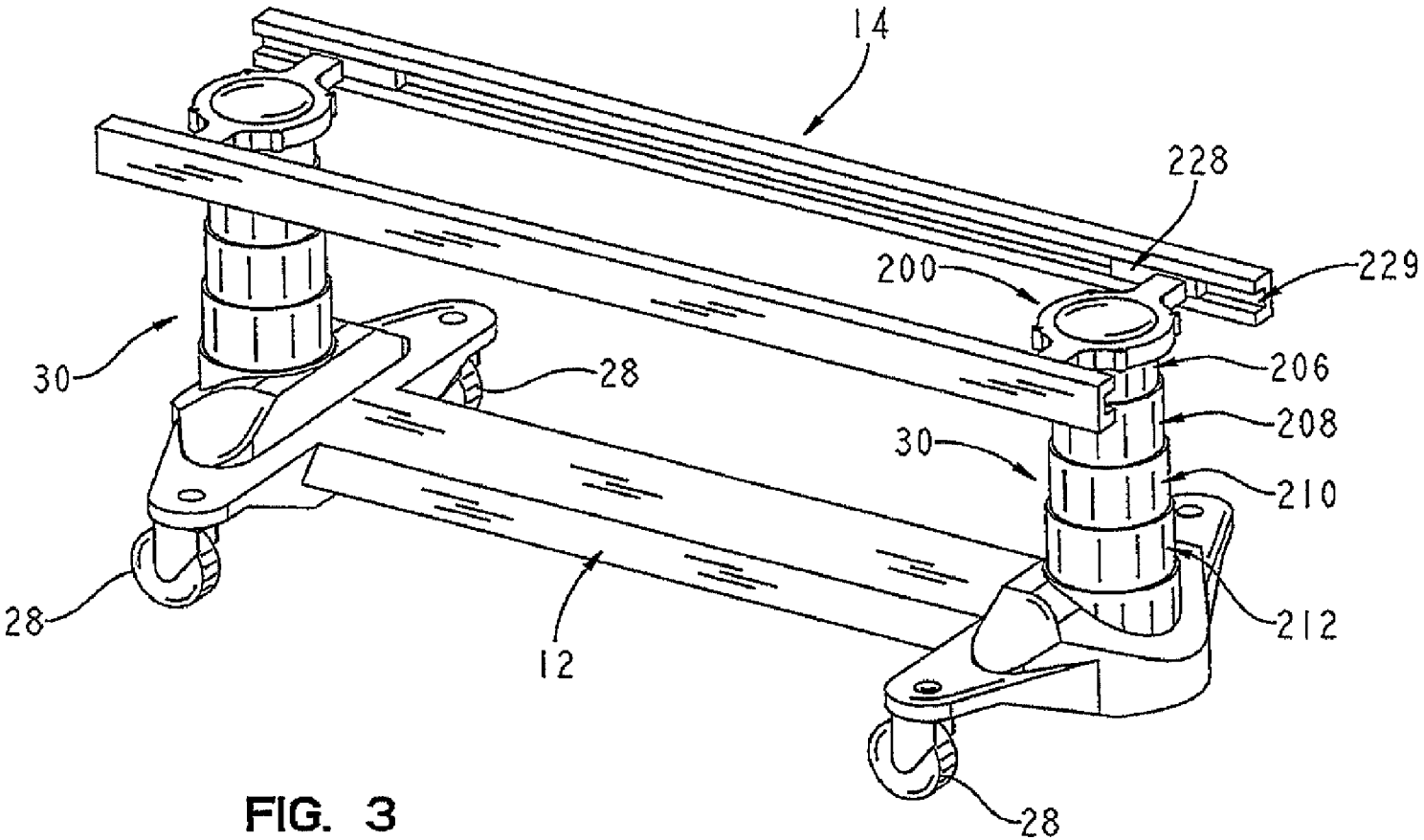
FIG. 3 is a perspective view of the patient support apparatus showing a base frame an intermediate frame and a pair of lifting devices each having a motor, a motor mount, and a lift assembly.
Figure 4:
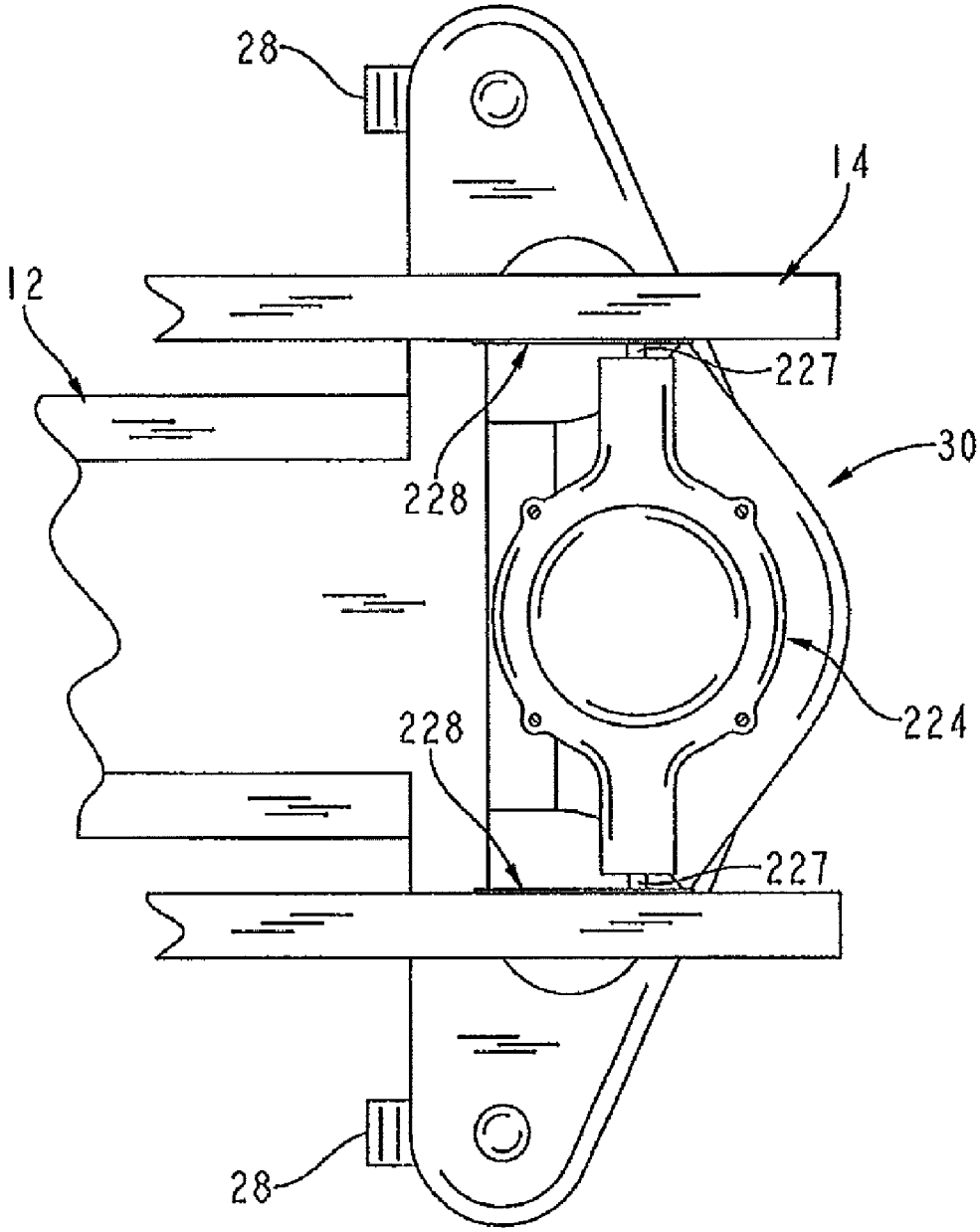
FIG. 4 is a top view showing the intermediate frame and one of the pair of lifting devices having a motor mount and a coupling member.

Head section 32 is pivotably and slidably coupled to a channel or rail 78 at pivot axis 76 (shown in phantom in FIG. 2). Rail 78 is coupled to intermediate frame 14. Rail 78 includes a slot (not shown) that allows pivot axis 76 of head section 32 to slide horizontally as head section 32 is moved between the substantially horizontal position as shown in FIG. 1 and the articulated position as shown in FIG. 2. A link 80 is pivotably coupled on one end to head section 32 at a pivot axis 82 and coupled to intermediate frame 14 on the other end at a pivot axis 84.

Referring now to FIGS. 1 and 2, as head section 32 rotates in direction 70 into the articulated position, pivot axis 76 slides in the slot in rail 78 towards foot board 22. Additional details of rail 78 and link 80 are provided in U.S. patent application Ser. No. 10/557,524, titled "Hospital Bed," filed Nov. 18, 2005 to Hensley et al. and PCT Publication No. WO 02/076266 A1, titled "Bed Equipped with a Back Elevator," filed Mar. 26, 2002, to Gippert et al., both of which are expressly incorporated by reference herein.

The illustrated embodiment of patient support apparatus 10 includes a control system to electronically control bed section articulation, raising and lowering of the intermediate frame, and/or various other bed functions. As shown in FIG. 1, the control system of patient support apparatus 10 includes siderail controls 112 coupled to head end siderails 24 and pendent controls 113 removably coupled to any of head and foot end siderails 24 and 26. Additional details of suitable siderail controls and pendant controls are provided in U.S. patent application Ser. No. 10/557,524, titled "Hospital Bed," filed Nov. 18, 2005 to Hensley et al., U.S. Pat. 6,658,680, titled "Hospital Bed," issued Dec. 9, 2003, to Osborne et al., and U.S. Patent Application Ser. 60/408,698, titled "Hospital Bed," filed Sep. 6, 2002, to Menkedick et al., all of which are expressly incorporated by reference herein.

As shown in FIGS. 3-6, lifting device 30 includes an upper assembly or mount 200, a motor 202, a motor mounting assembly 204, an upper canister 206, a first intermediate canister 208, a second intermediate canister 210, and a lower canister 212. Upper assembly 200 includes an upper body 224, a motor housing 226, a slide 227, and an intermediate frame coupler 228. Motor 202 includes a body 214, a shaft 216, and a mounting cap 230. Body 214 is positioned in motor housing 226, and mounting cap 230 is affixed to an interior cap (not shown) in motor housing 226. The connection between mounting cap 230 and the interior cap prevents motor 202 from rotating within motor housing 226. The connection between mounting cap 230 and the interior cap could include bolts, welding, or any other type of mounting known to those skilled in the art. Additionally, motor housing 226 could include members (not shown) for cooperation with cutouts 232 on mounting cap 230 to prevent rotation of motor 202.

Figure 5:
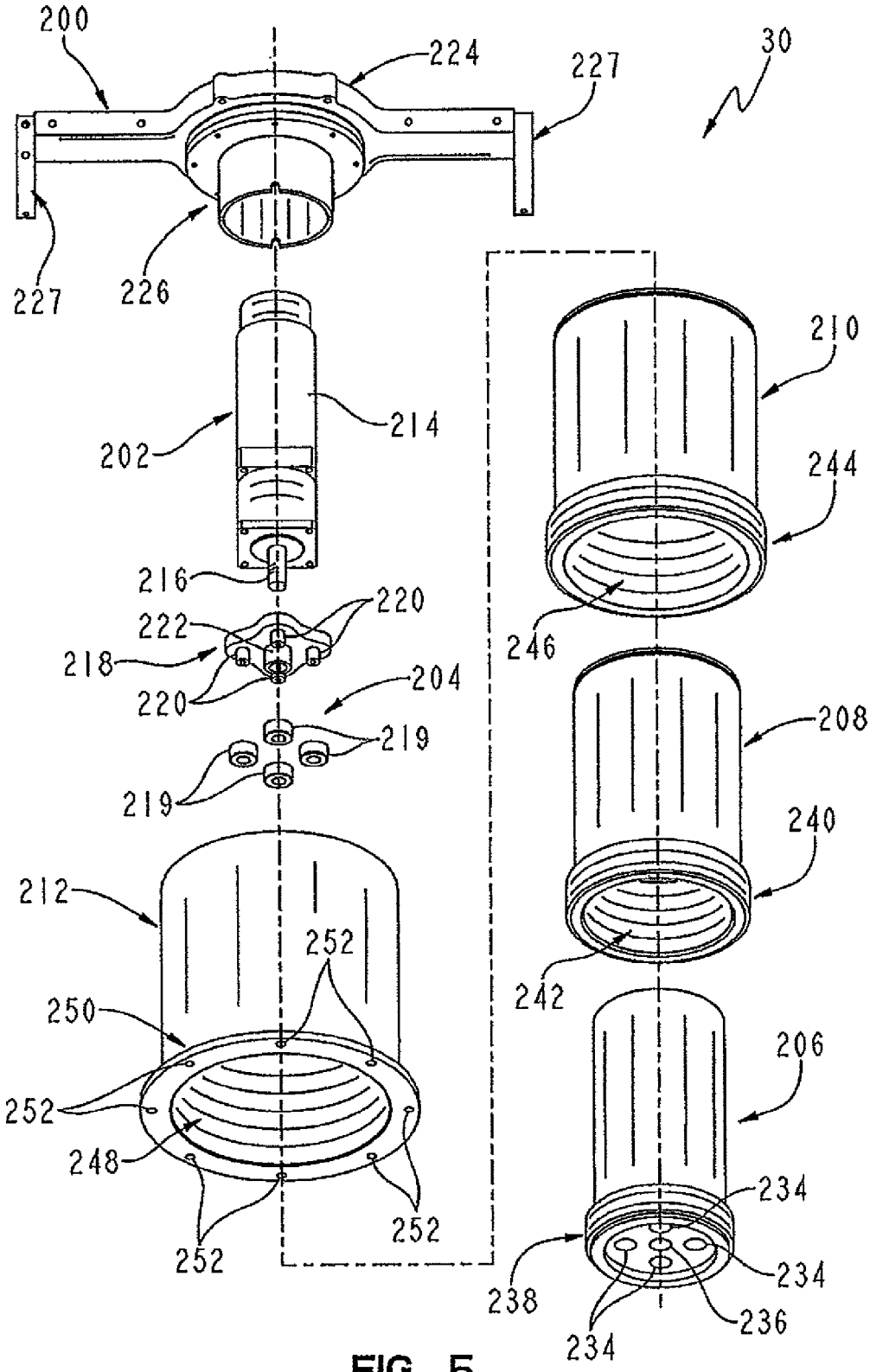
FIG. 5 is an exploded view of the lifting device.
Figure 6:
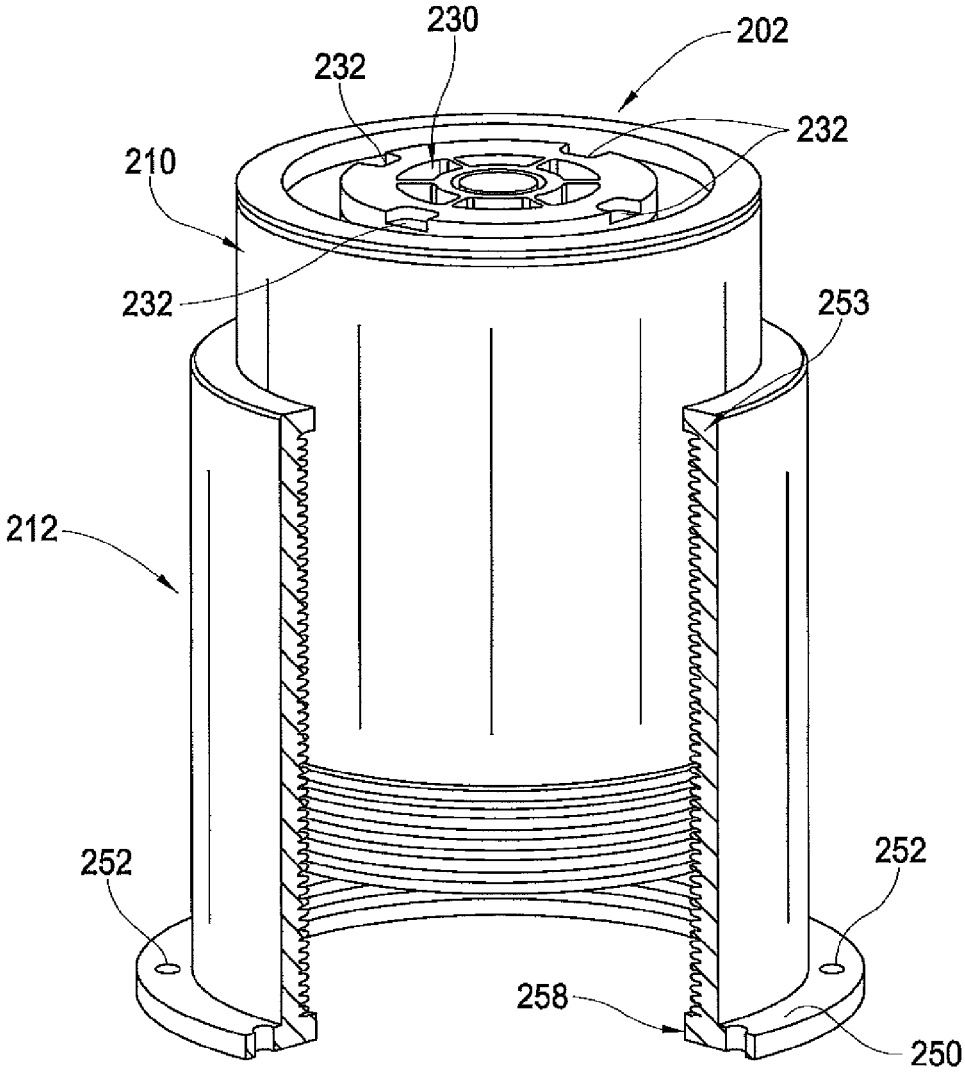
FIG. 6 is a perspective cutaway view of the lift assembly in a lowered position.

As shown in FIG. 5, motor mounting assembly 204 includes a motor coupler 218 and a plurality of elastomer mounts 219. Coupler 218 includes a plurality of upper assembly engagement members 220 and a shaft engagement member 222. Shaft engagement member 222 is configured to receive shaft 216 to translate rotation of motor 202 to upper canister 206. Upper canister 206 includes elastomer mount openings 234, shaft opening 236, and a threaded portion 238. Upper canister 206 receives upper assembly engagement members 220 by receiving elastomer mounts 219 that hold engagement members 220 in openings 234.

Figure 7:
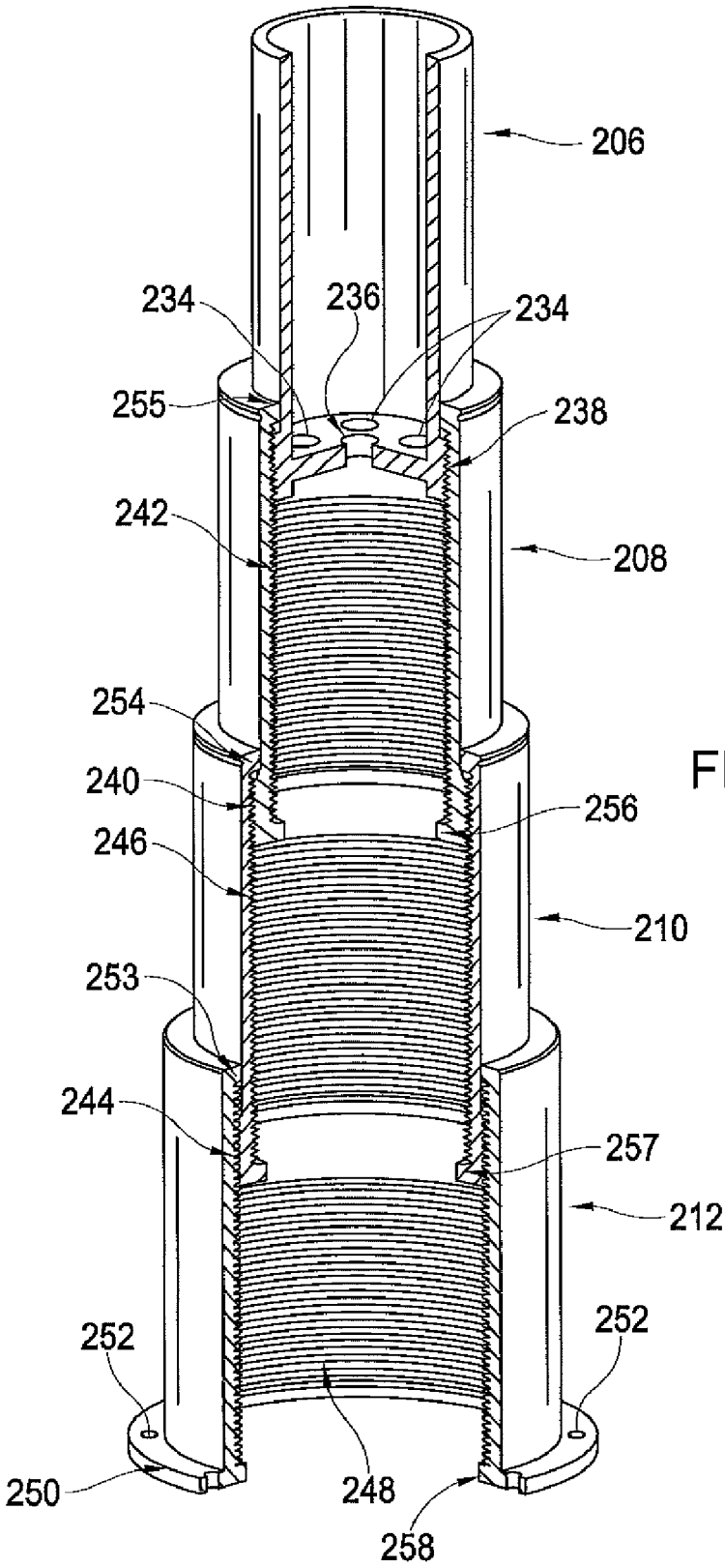
FIG. 7 is a perspective cutaway view of the lift assembly in an extended position showing a tower canister, a first intermediate canister, a second intermediate canister, and an upper canister.

As shown in FIGS. 5 and 7, upper canister 206 couples to first intermediate canister 208. First intermediate canister 208 couples to second intermediate canister 210. Second intermediate canister 210 couples to lower canister 212. First intermediate canister 208 includes a first outer threaded portion 240 and first inner threaded portion 242. Second intermediate canister 210 includes a second outer threaded portion 244 and a second inner threaded portion 246. Lower canister 212 includes an inner threaded portion 248 and a base plate 250. Base plate 250 includes openings 252 configured to receive bolts (not shown) for coupling of base plate 250 to base frame 12.

In configuration, threaded portion 238 of upper canister 206 is configured to thread with first inner threaded portion 242 of first intermediate canister 208. First outer threaded portion 240 of first intermediate canister 208 is configured to thread with second inner threaded portion 246 of second intermediate canister 210. Second outer threaded portion 244 of second intermediate canister 210 is configured to thread with inner threaded portion 248 of lower canister 212. In some embodiments, threaded portion 238, first outer threaded portion 240, and second outer threaded portion 244 all extend substantially the entire height of each of the respective canisters 206, 208, and 210. In other embodiments, threaded portion 238, first outer threaded portion 240, and second outer threaded portion 244 all extend a portion of the height of each of the respective canisters 206, 208, and 210.

A first thread stop 253 is provided in lower canister 212, a second thread stop 254 is provided in second intermediate canister 210, and a third thread stop 255 is provided in first intermediate canister 208. Further, thread stops 256, 257, and 258 are present in respective canisters 208, 210, and 212. In some embodiments, thread stops 253, 254, 255, 256, 257, and 258 are an object or barrier piece placed in respective threads. In other embodiments, thread stops 253, 254, 255, 256, 257, and 258 are a missing thread. In still other embodiments, thread stops 253, 254, 255, 256, 257, and 258 are a lip extending into the respective canisters 206, 208, and 210. The thread stops are configured to establish a raised or lowered position or related to movement of the canisters. For example, stop 255 is configured to transfer the upward motion of canister 206 to canister 208 such that both canisters are moving upwardly. Once the canister 206 comes into contact with stop 255, the upward motion of canister 208 begins, resulting in both canisters 206 and 208 moving upwardly. At this point, canister 206 will not be rotating with respect to canister 208, but rather canister 208 will be rotating with respect to canister 210, and such rotation of canister 208 will cause canisters 206 and 208 to move upwardly. Stop 254 provides a similar transfer of upward motion between canisters 208 and 210, and stop 253 provides a similar transfer of upward motion between canisters 210 and 212. Stops 256,257, and 258 are provided and configured to allow lowering of the canisters. As canister 206 is being lowered, it will come into contact with stop 256. Stop 256 will stop the relative rotation and lowering of canister 206 with respect to canister 208 and transfer the rotation to canister 208. Canister 208 will then rotate and lower along with canister 206 until the point that canister 208 comes into contact with lip 257. At this time, stop 257 will stop the relative rotation and lowering of canisters 206 and 208 with respect to canister 210 and transfer the rotation to canister 210. Canister 210 will then rotate and lower along with canisters 206 and 208 until the point that canister 210 comes into contact with lip 258. At this point, the canisters will be in their fully retracted or lowered position.

In operation from the lowered position (FIGS. 6 and 9) to the raised position (FIGS. 7 and 8), lower canister 212 is coupled to base frame 12. With lower canister 212 fixed, motor 202 provides rotational movement to tipper canister 206. The rotating of tipper canister 206 causes threaded portion 238 to cooperate with the first inner threaded portion 242, causing upper canister 206 to translate upwards. Once threaded portion 238 contacts third stop 255, first intermediate canister 208 begins rotational movement. The rotating of first intermediate canister 208 causes outer threaded portion 240 to cooperate with the second inner threaded portion 246 causing first intermediate canister 208 to translate upwards. Once threaded portion 240 contacts second stop 254, second intermediate canister 2 10 begins rotational movement. The rotating of second intermediate canister 210 causes outer threaded portion 244 to cooperate with the inner threaded portion 248 causing second intermediate canister 210 to translate upwards until the outer threaded portion 244 contacts first stop 253. Once the second intermediate canister 210 stops rotating and thus ceases translating upwards, the lifting device 30 has reached its maximum height. It should further be understood that at any point between the time when motor 202 begins providing rotational movement to upper canister 206 and the time when the second intermediate canister 210 stops rotating due to coming into contact with first stop 253, the rotation could be stopped at a transitional position such that the canisters are not at a full extended position. Turning off the motor would be one way that the rotation could be stopped at a transitional position.

It should be understood that the terms threadably engage, engage, and cooperate, and their variations, are used interchangeably throughout this specification. All instances of their usage should be interpreted as interchangeable with usage of the other terms, and thus no limitation is meant or should be interpreted by one usage over the other.

As mentioned above, a device is provided to hold motor 202 and prevent it from rotating with the canisters. In the illustrated embodiment, mount 200 is provided to hold motor 202 and also to translate the vertical movement caused by canisters 206, 208, 210, and 212 to intermediate frame 12. Any similar structure to mount 200 could be used to hold motor 202 and prevent it from rotating with the canisters as well as translating vertical movement caused by canisters 206, 208, 210, and 212 to intermediate frame 12.

Another embodiment of the present invention includes operating lifting devices 30 independently. Independent operation of lifting devices 30 allows for frame articulation to move the patient support apparatus into the Trendelenburg or Reverse Trendelenburg position. To facilitate movement of only one lifting device 30, intermediate frame coupler 228 couples to intermediate frame 12. Slide 227 is received within intermediate frame coupler 228 for lateral and pivotal movement within intermediate frame coupler 228. The pivoting and lateral movement of slide 227 allows for a slight change in orientation of mount 200 to allow for lifting devices 30 to be operated at different heights.

As is evident from the accompanying figures, multiple lifting devices are contemplated. Generally, one lifting device will be near the head end of patient support 10, and a second lifting device will be near the foot end of patient support apparatus 10. Thus, at least one controller would be used for the lifting devices so that operation of the controller would allow a level raising and/or lowering of the patient support apparatus to occur. It is also contemplated that more than one controller could be used to operate the lifting devices separately. Thus, a caregiver would operate separately one lifting device to adjust one of the head end or the foot end of the patient support apparatus.

It is further contemplated that more than two lifting devices could be used, and it is further contemplated that the location and situation of each of the lifting devices could be anywhere that suitable support is needed for a patient support apparatus. For example, four lifting devices could be used, one each at the respective four corners of the patient support apparatus. In this example, operation of any one of the lifting devices separately from the others would cause the patient support apparatus to adjust at that corner of the lifting device being operated. However, all four lifting devices acting in conceit would raise and lower the patient support apparatus in a simultaneous fashion.

In some embodiments, less than four canisters or more than four canisters may be used. If more than two canisters are used, the middle canisters are round shaped and contain both the internal or external threads as described above for intermediate canisters 208 and 210. If only two canisters are utilized, upper canister 206 is sized so threaded portion 238 is received in inner threaded portion 248. In some embodiments, additional lifting devices may be provided to allow lateral movement of patient support apparatus. In some embodiments, a cover (not shown) or shroud could be placed over at least a portion of lifting devices 30.

Preferably, instructions for the assembly, installation, and/or use of patient support apparatus 10 are provided with patient support apparatus 10 or otherwise communicated to permit a person or machine to assemble, install, and/or use patient support apparatus 10. Such instructions may include a description of any or all portions of patient support apparatus 10 and/or any or all of the above-described assembly, installation, and use of patient support apparatus 10 or components of patient support apparatus 10. The instructions may be provided on separate papers and/or on the packaging in which patient support apparatus 10 is sold or shipped. These instructions may also be provided over the Internet or other communication system. Furthermore, the instructions may be embodied as text, pictures, audio, video, or any other medium or method of communicating instructions known to those of ordinary skill in the art.

The features of the present description have been described with respect to beds, but they can also be used on examination tables, stretchers, gurneys, wheel chairs, chair beds, or any other patient support apparatus devices for supporting a person during rest, treatment, or recuperation.

Further, it is also within the scope of the present invention to accommodate variable sized patients, including bariatric patients of up to 1000 pounds or more. To accommodate patients of varied sizes, the patient support apparatus may include a width of tip to 50 inches or more.

While the invention has been illustrated and described in detail in the drawings and foregoing description, the same is to be considered as illustrative and not restrictive in character, it being understood that only selected embodiments have been shown and described and that all changes, modifications, and equivalents that come within the scope of the inventions described herein and/or defined by the following claims are desired to be protected. Any theory, mechanism of operation, proof, or finding stated herein is meant to further enhance understanding of the present invention and is not intended to limit the present invention in any way to such theory, mechanism of operation, proof, or finding.

What is claimed is:

1. A person support apparatus, comprising:

a base frame;

an intermediate frame supported above the base frame;

a lift mechanism configured to engage the base frame and the intermediate frame to support the intermediate frame above the base frame, the lift mechanism including a plurality of telescoping canisters configured to rotate with respect to one another to raise and lower the intermediate frame with respect to the base frame;

a motor positioned within at least one of the plurality of telescoping canisters, said motor mechanically coupled to and configured to rotate at least one of the plurality of telescoping canisters, said motor configured to move substantially vertically with at least one of the plurality of telescoping canisters to raise and lower the intermediate frame with respect to the base frame.

2. The person support apparatus of claim 1, wherein the plurality of telescoping canisters includes an upper canister and a lower canister, the motor is positioned concentrically within the upper canister.

3. The person support apparatus of claim 1, wherein the plurality of telescoping canisters includes an upper canister and a lower canister, the motor is secured to the upper canister and to a motor mount coupled to the intermediate frame to couple the lift mechanism to the intermediate frame.

4. The person support apparatus of claim 1, wherein the plurality of canisters includes an upper canister and a lower canister, the lower canister includes a first stop configured to establish a raised position of the upper canister.

5. The person support apparatus of claim 1, wherein the plurality of canisters includes an upper canister and a lower canister, the lower canister includes a second stop configured to establish a lowered position of the upper canister.

6. The person support apparatus of claim 1, wherein the plurality of canisters includes an upper canister and a lower canister and at least one intermediate canister positioned between the upper canister and the lower canister.

7. The person support apparatus of claim 6, wherein the at least one intermediate canister includes a first outer threaded portion for cooperation with an inner threaded portion of the lower canister and a first inner threaded portion for cooperation with an outer threaded portion of the upper canister.

8. The person support apparatus of claim 6, wherein the at least one intermediate canister includes a third stop configured to establish a raised position of the upper canister.

9. The person support apparatus of claim 1, wherein the plurality of canisters includes an upper canister and a lower canister, the upper canister includes an outer threaded portion and the lower canister includes an inner threaded portion, the outer threaded portion of the upper canister engages the inner threaded portion of the lower canister.

10. The person support apparatus of claim 1, further comprising a mount configured to couple the lift mechanism to the intermediate frame such that the lift mechanism is able to at least one of pivot and translate with respect to the intermediate frame as the intermediate frame moves between a Trendelenburg and reverse Trendelenburg position with respect to the base frame.

11. A person support apparatus, comprising:

a base frame;

an intermediate frame supported above the base frame;

a lift mechanism configured to engage the base frame and the intermediate frame to support the intermediate frame above the base frame, the lift mechanism including a first telescoping canister and a second telescoping canister configured to rotate with respect to one another to raise and lower the intermediate frame with respect to the base frame, the second telescoping canister being coupled to the base frame; and a motor positioned within said first telescoping canister and mechanically coupled to said intermediate frame and said first telescoping canister, said motor configured to rotate said first telescoping canister with respect to the intermediate frame.

12. The person support apparatus of claim 11 further comprising a mount configured to couple the lift mechanism to the intermediate frame such that the lift mechanism is able to at least one of pivot and translate with respect to the intermediate frame as the intermediate frame moves between a Trendelenburg and reverse Trendelenburg position with respect to the frame.

13. The person support apparatus of claim 11, wherein the motor is secured to the first canister and to a motor mount coupled to the intermediate frame to couple the lift mechanism to the intermediate frame.

14. The person support apparatus of claim 11, wherein the second canister includes a first stop configured to establish a raised position of the first canister.

15. The person support apparatus of claim 11, wherein the second canister includes a second stop configured to establish a lowered position of the first canister.

16. The person support apparatus of claim 11, wherein the lift mechanism further includes at least one intermediate canister positioned between the first canister and the second canister.

17. The person support apparatus of claim 16, wherein the at least one intermediate canister includes a first outer threaded portion for cooperation with an inner threaded portion of the second canister and a first inner threaded portion for cooperation with an outer threaded portion of the first canister.

18. The person support apparatus of claim 16, wherein the at least one intermediate canister includes a third stop configured to establish a raised position of the first canister.

19. The person support apparatus of claim 11, wherein the first canister includes an outer threaded portion and the second canister includes an inner threaded portion.

20. The person support apparatus of claim 19, wherein the outer threaded portion of the first canister engages the inner threaded portion of the second canister.

21. A person support apparatus, comprising:

a base frame;

an intermediate frame supported above the base frame;

a plurality of telescoping canisters configured to rotate with respect to one another, said plurality of telescoping canisters configured to mechanically connect said intermdiate frame and said base frame; and a motor positioned within at least one of the plurality of telescoping canisters, said motor mechanically coupled to and configured to rotate at least one of the plurality of telescoping canisters with respect to at least one other of said plurality of telescoping canisters to raise and lower the intermediate frame with respect to the base frame.

22. The person support apparatus of claim 21 further comprising a mount with an intermediate frame coupler and a motor coupling portion, the intermediate frame coupler being movably coupled to the intermediate frame such that the motor coupling portion is pivotable and translatable with respect to the intermediate frame as the intermediate frame moves between a Trendelenburg and reverse Trendelenburg position with respect to the base frame.

23. The person support apparatus of claim 21, wherein the plurality of canisters includes an upper canister and a lower canister, the motor is configured to rotate the upper canister with respect to the lower canister and is positioned within the upper canister.

24. The person support apparatus of claim 23, wherein the lower canister includes a first stop configured to establish a raised position of the upper canister.

25. The person support apparatus of claim 23, wherein the lower canister includes a second stop configured to establish a lowered position of the upper canister.

26. The person support apparatus of claim 23, wherein the plurality of canisters includes at least one intermediate canister positioned between the upper canister and the lower canister.

27. The person support apparatus of claim 26, wherein the at least one intermediate canister includes a first outer threaded portion for cooperation with an inner threaded portion of the lower canister and a first inner threaded portion for cooperation with an outer threaded portion of the upper canister.

28. The person support apparatus of claim 26, wherein the at least one intermediate canister includes a third stop configured to establish a raised position of the upper canister.

29. The person support apparatus of claim 23, wherein the upper canister includes an outer threaded portion and the lower canister includes an inner threaded portion.

30. The person support apparatus of claim 29, wherein the outer threaded portion of the upper canister engages the inner threaded portion of the lower canister.

* * * * *